US008651038B2

(12) United States Patent
Luo et al.

(10) Patent No.: US 8,651,038 B2
(45) Date of Patent: Feb. 18, 2014

(54) SYSTEM AND METHOD FOR MULTI-SECTIONAL TRUSS SPAR HULL FOR OFFSHORE FLOATING STRUCTURE

(75) Inventors: Michael Y. H. Luo, Bellaire, TX (US); Zhengquan Zhou, Houston, TX (US); Joseph M. Gebara, Houston, TX (US)

(73) Assignee: Technip France, Courbevoie (FR)

( * ) Notice: Subject to any disclaimer, the term of this patent is extended or adjusted under 35 U.S.C. 154(b) by 464 days.

(21) Appl. No.: 13/015,949

(22) Filed: Jan. 28, 2011

(65) Prior Publication Data

US 2012/0195690 A1 Aug. 2, 2012

(51) Int. Cl.
*B63B 38/00* (2006.01)

(52) U.S. Cl.
USPC ..... 114/65 R; 114/264; 405/195.1

(58) Field of Classification Search
USPC ..... 114/264, 265, 65 R; 405/203–209, 405/195.1
See application file for complete search history.

(56) References Cited

U.S. PATENT DOCUMENTS 6,161,620 A * 12/2000 Cox et al. ..... 166/367
6,340,272 B1 1/2002 Runge et al.

OTHER PUBLICATIONS

International Search Report for International Patent Application No. PCT/US2012/022382; European Patent Office, dated Mar. 14, 2012.
Written Opinion for International Patent Application No. PCT/US2012/022382; European Patent Office, dated Mar. 14, 2012.
Sablok, A., Liu, C., Gebara, J., Cattell, A. and Perryman, S., "Mating of the Holstein Hard Tank and Truss—Challenges, Execution, Dimensional Control and Analysis", 2005 Offshore Technology Conference, May 2-5, 2005, Houston, Texas, copyright 2005 Offshore Technology Conference.

* cited by examiner

*Primary Examiner* — Edwin Swinehart
(74) *Attorney, Agent, or Firm* — Locke Lord LLP

(57) ABSTRACT

The present disclosure provides an improved design for a multi-sectional truss spar hull platform having a truss and a spar hull. One or more sections can be transported to a designated location and off-loaded into water from an available transport vessel. The truss includes a skirt tank at the upper end of truss that can be coupled to the lower end of the hull. The skirt tank can provide buoyancy during float-off and mating operations to the hull. The skirt tank is designed to allow the portion above the water to be coupled to the hull in a first orientation, the truss with the skirt tank rotated with the hull in the water to a second orientation to expose the previously underwater portion, and then the previously underwater portion can be coupled together above the water. The integral skirt tank will be flooded after the spar hull is up-ended.

9 Claims, 4 Drawing Sheets

SYSTEM AND METHOD FOR MULTI-SECTIONAL TRUSS SPAR HULL FOR OFFSHORE FLOATING STRUCTURE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates to offshore floating structures. More particularly, the disclosure relates to large, multi-sectional, offshore floating structures that are fabricated and then assembled while floating in water.

2. Description of the Related Art

A spar platform is a type of floating offshore structure typically used in very deep waters and is among the largest offshore platforms in use. A spar platform includes a large cylinder or hull supporting a typical rig topsides. The hull does not extend all the way to the seafloor and typically rely on a traditional mooring system to maintain their position. The spar platform can further include a truss structure of a generally open construction that is disposed below the floating hull. The truss can support risers and provide stability for the hull. The combination has been termed a "truss spar hull" platform. Typically, about 90% of the platform is underwater. The large hull and/or truss serves to stabilize the platform in the water, and allows movement to absorb the force of potential high waves, storms or hurricanes.

An exemplary truss spar hull platform can be about 250 meters long and about 45 m in diameter. The size of some such platforms has traditionally been limited by the capacity of vessels to haul the platform. There has been a desire to manufacture a larger platform than the vessels are capable of carrying.

FIG. 1 is a side schematic view of a prior art truss spar hull with an additional temporary float tank using a method to couple a truss with a spar hull. In at least one prior art example, a truss spar hull platform 2 was produced by fabricating a hull 4 in one fabrication yard and a truss 6 in different fabrication yard. The truss 6 included four (4) legs 10 with bracing 12 therebetween. The hull 4 was hauled by a vessel to the truss fabrication yard and offloaded into a quay adjacent the fabrication yard. The hull 4 with its traditional float compartments was floated on its side in the quay with a water level 8 above the seabed 20. On their sides, the hull and truss extended about 14 stories high. The open structure truss 6 used a temporary float tank 14 and a float tank 16 with wing tanks extending outward from the truss, the tanks having multiple chambers to adjust and ballast to help align the floating truss with the floating hull. The truss 6 was floated in the quay with the temporary float tank 14 toward an upper end of the truss and a float tank 16 toward a lower end of the truss. Special cofferdams 22, each weighing about 35 tons, were lowered into the water, sealed around the legs 10 and other components that were underwater, and pumped dry to allow welding therein. The temporary float tank 14 and the float tank 16 were ballasted to adjust an alignment of the legs 10 in conjunction with a special mating guides 24 on the truss legs 10 to corresponding mating portions 26 on the hull 4. The truss legs 10 and bracing 12 were welded to the hull 4. The welding was done sequentially on different portions of the two sections, because the different portions required different alignments for proper welding precision. Other special fabrication and ballasting techniques were used to connect the two sections. After the welding, the remaining components for the offshore structure were assembled to the combined structure and the entire structure floated to an offshore installation site.

Thus, while the fabrication process showed that the truss and hull could be made separately and assembled while floating to complete fabrication of such a large offshore structure, the process was costly and intricate. The fabrication was considerably challenging to align the large components and maintain alignment and dimensional control during the welding and in underwater conditions using the cofferdams.

There remains a need for an improved system and method of assembling multi-sectional truss spar hull platforms.

BRIEF SUMMARY OF THE INVENTION

The present disclosure provides an improved design for a multi-sectional truss spar hull platform having a truss and a spar hull. One or more sections can be transported to a designated location and off-loaded into water from an available transport vessel. The truss includes a skirt tank at the upper end of truss that can be coupled to the lower end of the hull. The skirt tank can provide buoyancy during float-off and mating operations to the hull. The skirt tank is designed to allow the portion above the water to be coupled to the hull in a first orientation, the truss with the skirt tank rotated with the hull in the water to a second orientation to expose the previously underwater portion, and then the previously underwater portion can be coupled together above the water. The integral skirt tank will be flooded after the spar hull is up-ended.

The disclosure provides a system for manufacturing a multi-sectional offshore floating platform, comprising a truss having one or more legs having an upper portion and a lower portion; and a skirt tank coupled to the upper portion of the legs, the skirt tank comprising: a peripheral outer shell; an upper deck disposed at least partially across a cross-sectional portion of the outer shell and coupled to the outer shell, the upper deck having a skirt mating portion; and a lower deck disposed at least partially across a cross-sectional portion of the outer shell and coupled to the outer shell distally from the upper deck and toward the lower portion of the legs; at least one deck having an opening therethrough and the skirt tank being buoyant above a water level that is lower than the opening. The multi-sectional offshore floating platform further comprises a hull having one or more buoyancy tanks and a hull mating portion disposed adjacent the skirt mating portion, the mating portions configured to be at least partially sealingly coupled together.

The disclosure also provides a method of manufacturing a multi-sectional offshore floating platform, the floating platform having at least two sections, one section being a truss with a skirt tank, the skirt tank having a peripheral outer shell with an upper deck and a lower deck disposed at least partially across a cross-sectional portion of the outer shell and coupled to the outer shell with an opening through at least one of the decks, the upper deck having a skirt mating portion, and a second section being a hull with a hull mating portion, the method comprising: floating the upper portion of the truss with the skirt tank at a water level that is below the opening in the decks; aligning the skirt mating portion and the hull mating portion; sealingly coupling a first portion of an interface between the skirt mating portion and the hull mating portion together above the water level in a first orientation; rotating the truss with the skirt mating portion and the hull with the hull mating portion to a second orientation around a longitudinal axis; and coupling a second portion of the interface between the skirt mating portion and the hull mating portion together above the water level in the second orientation that was previously below the water level in the first orientation.

DETAILED DESCRIPTION OF THE INVENTION

Figure 1:
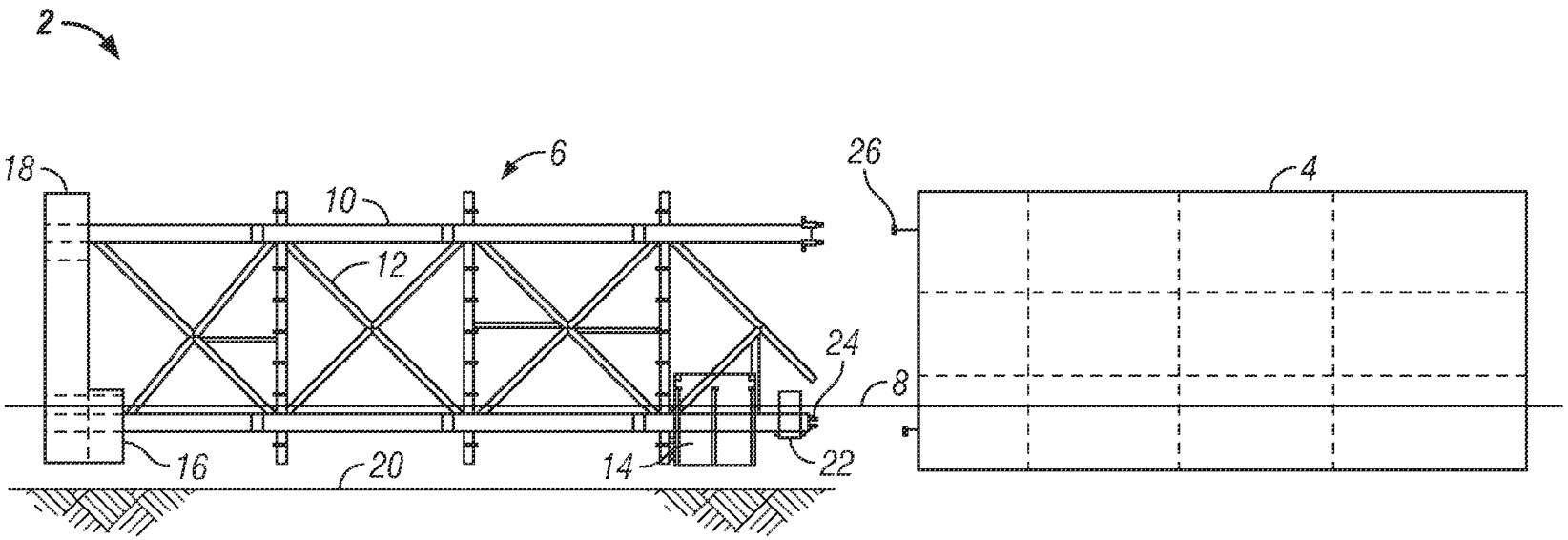
FIG. 1 (Prior Art)
FIG. 1 is a side schematic view of a prior art truss spar hull with an additional temporary float tank using a method to couple a truss with a spar hull.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "upper," "lower," "left," "right," "upper," "lower," "down," "up," "side," and the like are used in the written description for clarity in specific reference to the Figures and are not intended to limit the scope of the invention or the appended claims. Where appropriate, some elements have been labeled with an "A or "B" to designate a member of a series of elements, or to describe a portion of an element. When referring generally to such elements, the number without the letter can be used. Further, such designations do not limit the number of elements that can be used for that function.

The present disclosure provides an improved design for a multi-sectional truss spar hull platform having a truss and a spar hull. One or more sections can be transported to a designated location and off-loaded into water from an available transport vessel. The truss includes a skirt tank at the upper end of truss that can be coupled to the lower end of the hull. The skirt tank can provide buoyancy during float-off and mating operations to the hull. The skirt tank is designed to allow the portion above the water to be coupled to the hull in a first orientation, the truss with the skirt tank rotated with the hull in the water to a second orientation to expose the previously underwater portion, and then the previously underwater portion can be coupled together above the water. The integral skirt tank will be flooded after the spar hull is up-ended.

Figure 2:
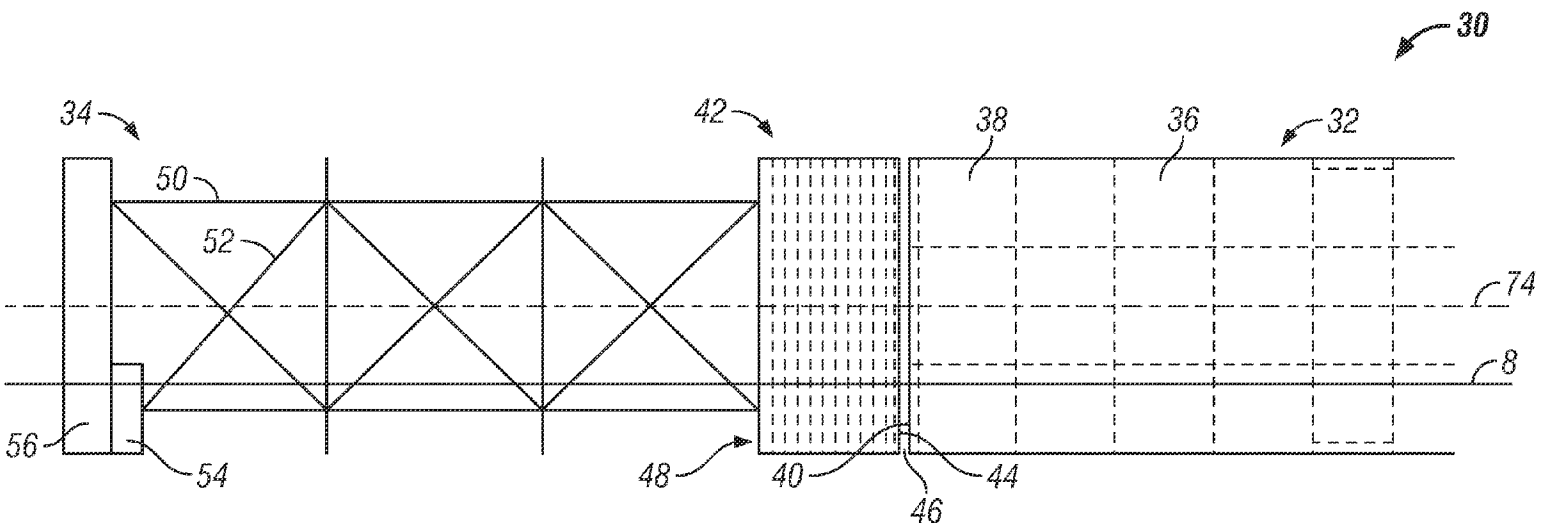
FIG. 2 is a side schematic view of an exemplary embodiment of a truss spar hull platform with a truss having a skirt tank adjacent a spar hull before assembly.

FIG. 2 is a side schematic view of an exemplary embodiment of a truss spar hull platform with a truss having a skirt tank adjacent a spar hull before assembly. The truss spar hull platform 30 includes one or more sections that can be coupled together. In the embodiment illustrated, a first section as a hull 32 can be coupled to a second section as a truss 34. The upper end of the hull and upper end of the truss, when oriented in a deployed position, is shown toward the right side of FIG. 2. The hull generally includes a hard tank 36 that has a fixed buoyancy capability and a variable ballast tank 38 that can be adjusted for buoyancy. After deployment, the variable ballast tank 38 can be used to raise and lower the level of the platform. Pre-deployment, in the orientation shown in FIG. 2, the variable ballast tank 38 can be used to adjust the elevation of a mating portion 40 of the hull to a corresponding mating portion of the truss.

The truss 34 includes a skirt tank 42 coupled with a framework of legs 50 and bracing 52. The skirt tank 42 has an upper deck 44 with a mating portion 46 to be coupled to the corresponding mating portion 40 on the hull 32. The skirt tank 42 also includes a lower deck 48 having an opening therethrough, as described below. The truss 34 includes a float tank 54 disposed toward the lower end of the truss and a soft tank 56 disposed at the lower end of the truss. The buoyancy of the float tank 54 can be adjusted to change an elevation of the lower end and/or angle of alignment of the mating portion 46 of the upper deck 44 to the mating portion 40 on the hull 32.

As generally described herein, the hull 32 can be manufactured separately from the truss 34. Due to the large size of the combined structure of truss spar hull platform, comparable to a 70-story building high and 15-story building wide, the truss 34 could be made at a separate fabrication yard from the hull 32, and brought to the hull 32 for coupling. It is envisioned that the coupling occurs when the two sections are disposed horizontally due to the platform size. Further, the coupling is envisioned to occur when the two sections are floating in a quay or other calm water area nearby to the fabrication yard. Generally, a portion of each cross-section of the truss 34 and hull 32 will be disposed below a water level 8 with a majority of each cross-section disposed above the water level 8.

The disclosure provides an innovative system and method of coupling the truss 34 with the hull 32 without requiring intricate alignment between multiple, legs, bracing, and other components. Further, the innovative system and method does not require underwater welding nor sealing around members to evacuate the water within the sealed volume for welding under dry conditions but below a water surface. The skirt tank 42 is able to provide buoyancy to the truss and yet be coupled permanently to the hull 32 and form a structural portion of the truss 34 with the legs 50 and bracing 52. The skirt tank 42 can be open to allow risers, umbilicals, and other components to be placed therethrough from the hull down through the lower portion of the truss when deployed.

Figure 3:
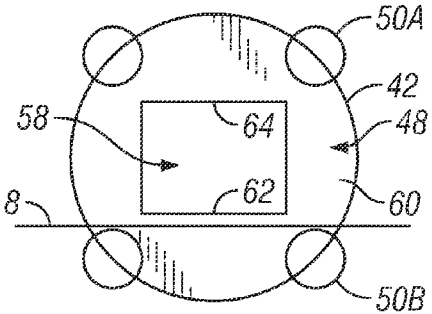
FIG. 3 is a lower end schematic view of a lower deck of the skirt tank of the truss.

FIG. 3 is a lower end schematic view of a lower deck of the skirt tank of the truss. A portion of the skirt tank 42 and a leg 50A is disposed above the water level 8 and a portion of the skirt tank 42 and a leg 50B is disposed below the water level.

The lower deck 48 generally includes a lower deck plate 60 with a center well opening 58 disposed therethrough. The lower deck 48 can include other structural members as required to support the plate 60 and other components. The center well opening 58 includes a first edge 62 and second edge 64. In the orientation shown in FIG. 3, the first edge 62 is closest to the water level 8. The first edge 62 is designed to be above the water level 8 when the truss 34 is horizontally disposed to keep water from flowing into the skirt tank 42 and flooding the skirt tank. As will be described regarding FIGS. 5-7, the orientation of the skirt tank 42 and first edge 62 is changed by rotating the hull and truss. In at least one embodiment, the hull and truss are rotated 180° so that the second edge 64 is disposed downwardly adjacent the water level 8 and the first edge 62 is upwardly disposed to where the second edge 64 is currently shown located in FIG. 3. Similar to the first edge 62, the second edge 64 is designed to be at an elevation above the water 8 so that the skirt tank 42 is not flooded when the coupling between the skirt tank 42 and the hull 32 occurs.

Figure 4:
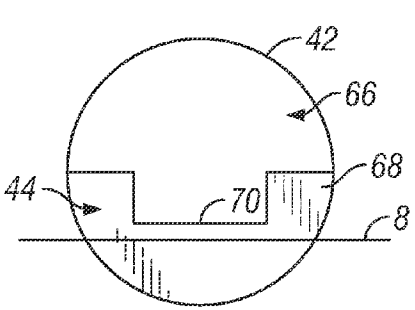
FIG. 4 is an upper end schematic view of an upper deck of the skirt tank.

FIG. 4 is an upper end schematic view of an upper deck of the skirt tank. The upper deck 44 of the skirt tank 42 includes an upper deck plate 68. However, in at least one embodiment, the upper deck plate only partially covers the cross-sectional area of the upper deck 44, leaving an upper deck opening 66. The upper deck plate 68 includes an edge 70 disposed above the water level 8 when the truss 34 with the skirt tank 42 is disposed horizontally for coupling with the hull 32.

As described in more detail below, when the truss 34 and hull 32 are coupled around the deck plate 68, the truss and hull can be rotated relative to a longitudinal axis 74 passing through the truss and hull lengths. The rotation exposes the remaining uncoupled portion between the truss and the hull that was underwater where the edge 70 is disposed away from the water level 8. The opening 66, which is underwater after the rotation, is precluded from allowing water to enter the portion of the skirt tank that is underwater, because coupling has occurred for that portion between the skirt tank and the hull prior to the rotation. Thus, the skirt tank 42 will not become flooded. After rotation, the coupling for the remainder of the truss and hull that was previously underwater can be finished above water.

Figure 6:
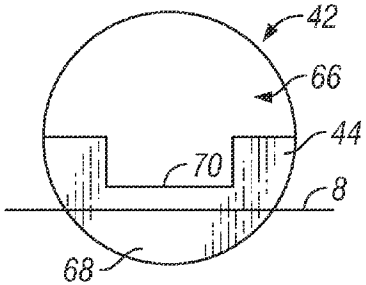
FIG. 6 is an end schematic view of the upper deck of the skirt tank oriented in the first orientation of FIG. 5.
Figure 5:
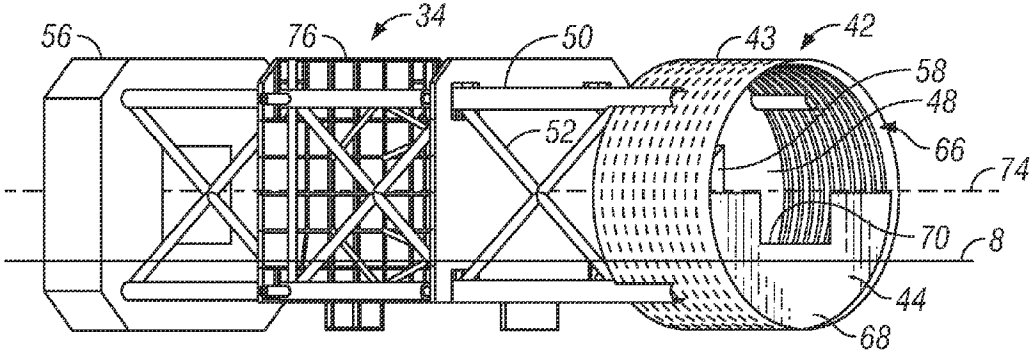
FIG. 5 is a perspective schematic view of the truss without the adjacent hull to illustrate a first orientation of the truss prior to coupling to the hull.

FIG. 5 is a perspective schematic view of the truss without the adjacent hull to illustrate a first orientation of the truss prior to coupling to the hull. FIG. 6 is an end schematic view of the upper deck of the skirt tank oriented in the first orientation of FIG. 5. The figures will be described in conjunction with each other. In FIG. 5, the hull 32 that is to be partially coupled to the skirt tank 42 of the truss 34 at this stage of the exemplary sequence is not shown to better view the orientation of the skirt tank 42.

Figure 7:
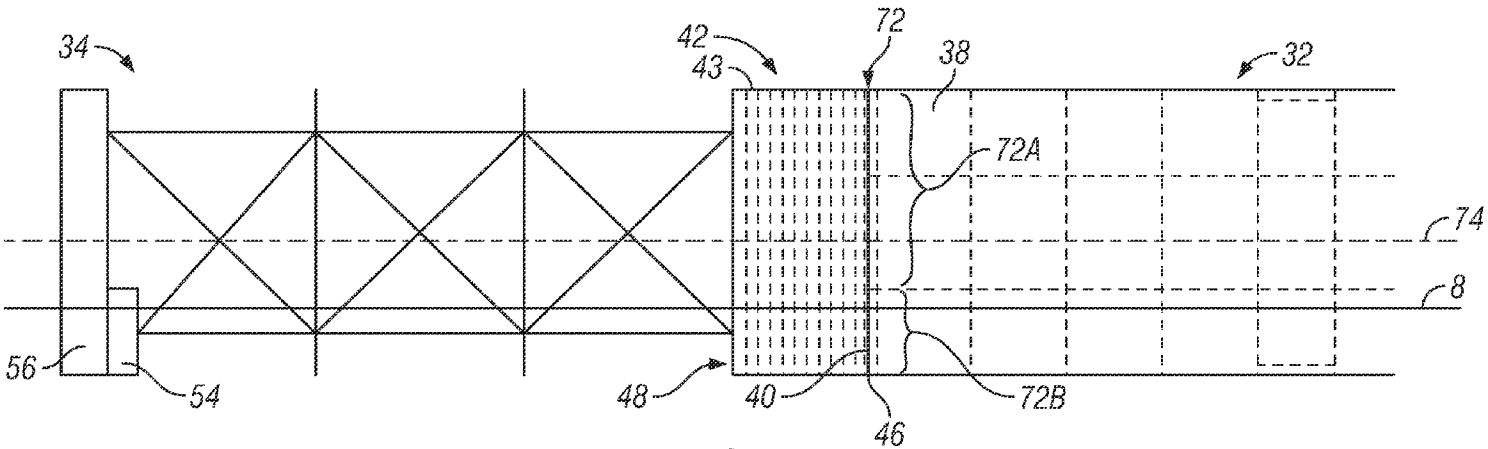
FIG. 7 is a side view of the truss sealingly coupled to the hull at a first interface portion in the first orientation above the water level.

In general, the truss 34 includes the legs 50, bracing 52, the skirt tank 42 coupled to an upper end of legs, and a float tank 54 and a soft tank 56 coupled to a lower end of the legs. One or more heave plates 76 can be coupled along the length of legs 50 as may be desirable for heave control and other measures. In general, the skirt tank 42 includes the upper deck 44 and the lower deck 48 with an outer shell 43 coupled therebetween. The inside of the skirt tank 42 between the lower and upper decks and within the outer shell can generally be open to accept components and structures later in the assembly sequence. A primary function of the skirt tank 42 is to provide temporary buoyancy during float-off and mating operations with the hull 32, such as shown in FIG. 7 below. The lower deck 48 can provide guides through the opening 58 for risers, such as upper tension risers ("TTRs"), steel catenary risers ("SCRs"), umbilicals, and other components. Further, the lower deck 48 can serve as a water separation barrier on the lower end of the skirt tank 42, when the truss 34 is disposed horizontally for assembly. The upper deck 44 can serve as a water separation barrier, when the truss is disposed horizontally during a first orientation before the mating portion 46 of the skirt tank 42 is coupled to the mating portion of the hull above the water level. The edge 70 of the upper deck 44 is designed to be disposed above the water level during the coupling of the mating portions to restrict the water from flowing into the skirt tank 42. The opening 66 in the upper deck can be greater in dimension than the center well opening 58 in the lower deck 48. The opening 66 can be greater in size, because the mating portion 46 of the skirt tank 42 above the water level will be sealingly coupled to the mating portion of the hull prior to rotating the truss and hull over for completing the coupling therebetween.

FIG. 7 is a side view of the truss sealingly coupled to the hull at a first interface portion in the first orientation above the water level. The truss spar hull platform 30 is shown with the truss 34 partially coupled to the hull 32 at an interface 72. The interface 72 is generally formed between the mating portion 40 of the hull 32 and the mating portion 46 of the skirt tank 42. Generally, an outer periphery of the hull 32 can correspond to an outer periphery of the outer shell 43 of the skirt tank 42. At least one option for coupling is to weld the mating portions together. Welding is structurally conducive and accepted in the industry. However, other forms of suitable coupling may be used. Thus, the reference to welding is only exemplary as a customary manner of coupling and is not meant to be limiting.

The skirt tank 42 and the float tank 54 and optionally soft tank 56 can keep the truss 34 floating in the water at the water level 8. The floatation of the truss 34, hull 32, or both can be adjusted to match the mating portions 40, 46 at the interface 72 for appropriate welding or other coupling. For example, the variable ballast tank 38 can be ballasted to lower a portion of the hull 32 as well as angularly align the mating portion 40 of the hull with the skirt mating portion 46. Similarly, the float tank 54 can be ballasted to change an angular alignment as well as elevation above the water level. In some embodiments, a limited amount of water can be intentionally accepted into the skirt tank 42 through valves, pumps, or other components to change the buoyancy of the skirt tank and therefore change the height above the water level 8 as well as angular alignment relative to the mating portion 40 of the hull 32. When the proper alignment is made, at least a portion of the interface 72 above the water level 8 can be coupled, such as welded together. It is not critical that the coupling occur down to the water level, but is important that the coupling sealingly occur sufficient so that when the platform is rotated over, the coupling will extend from below the water level to a place above the water level and not allow substantial leakage into the skirt tank to maintain temporary buoyancy. As an example, the first interface portion 72A could be coupled while the second interface portion 72B, which extends below the water level 8, would not be coupled in this first orientation of the truss 34 and hull 32.

Figure 9:
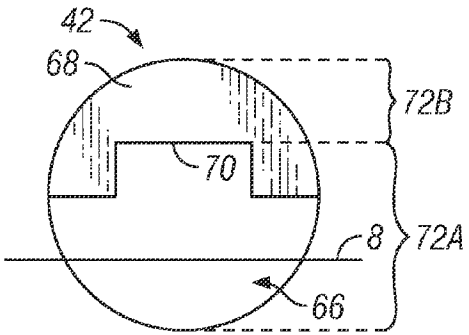
FIG. 9 is an end schematic view of the upper deck of the skirt tank oriented in the second orientation of FIG. 8.
Figure 8:
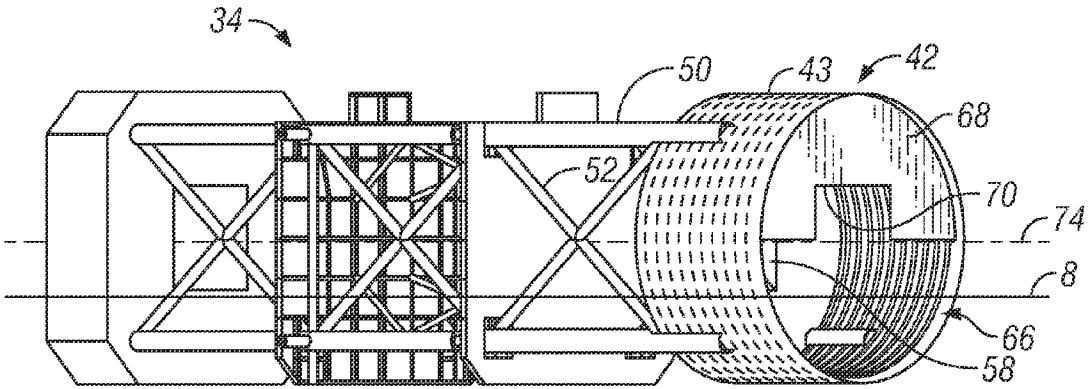
FIG. 8 is a perspective schematic view of the truss without the adjacent hull to illustrate a second orientation of the truss that is rotated from the first orientation.

FIG. 8 is a perspective schematic view of the truss without the adjacent hull to illustrate a second orientation of the truss that is rotated from the first orientation. FIG. 9 is an end schematic view of the upper deck of the skirt tank oriented in the second orientation of FIG. 8. The figures will be described in conjunction with each other. In FIG. 8, the hull 32 that is partially coupled to the skirt tank 42 of the truss 34 from the prior stage of the exemplary sequence is not shown to better view the orientation of the skirt tank 42.

The truss 34 and the hull are rotated to the second orientation with the upper deck plate 68 disposed upwardly relative to the first orientation, shown in FIG. 5. The first portion 72A of the interface is sealingly coupled to the hull 32. The hull is partially coupled with the skirt tank, so that even though the opening 66 is otherwise disposed below the water level, the coupling to the hull does not allow water to come into the skirt tank 42. The remaining second portion 72B of the interface has not been coupled yet in the exemplary sequence, because it was underwater in the first orientation.

Figure 10:
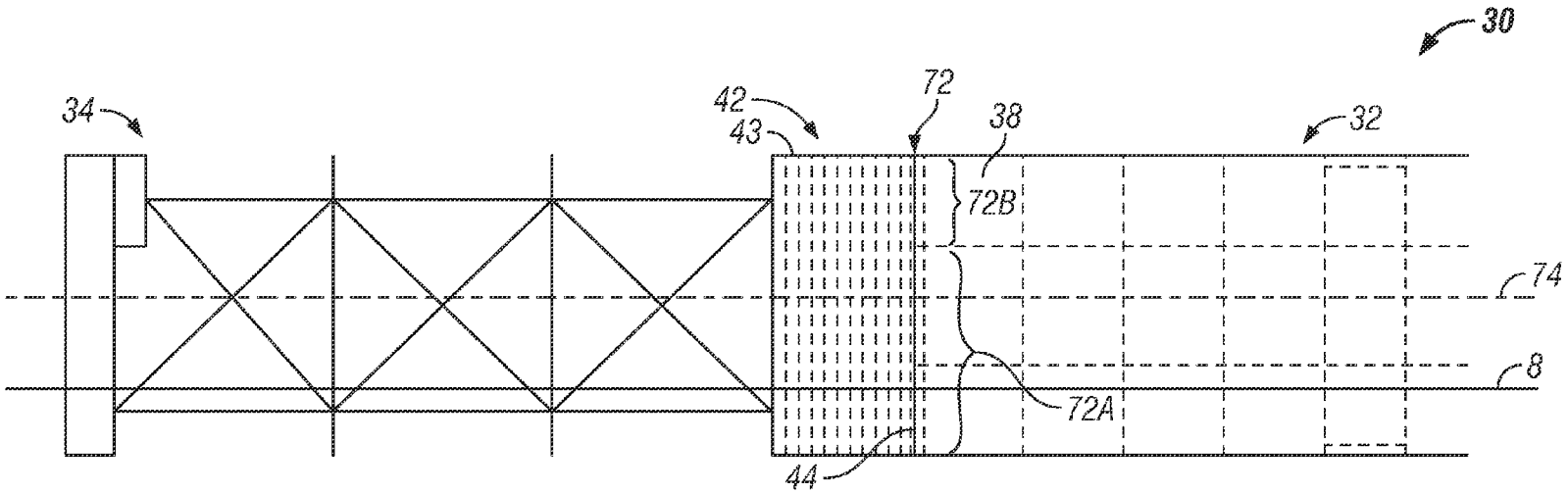
FIG. 10 is a side view of the truss sealingly coupled with the hull at a second interface portion in the second orientation above the water level.

FIG. 10 is a side view of the truss sealingly coupled with the hull at a second interface portion in the second orientation above the water level. With the hull 32 and truss 34 rotated over in the water, the second portion of 72B of the interface is now above the water level 8 and the first portion 72A of the interface is at least partially below the water level 8. The second portion 72B of the interface can be coupled between the skirt tank 42 and the hull 32. Because the first portion 72A of the interface has already been sealingly coupled, the opening 66 is no longer open to water and does not allow water to enter the skirt tank. Therefore, the buoyancy of the skirt tank 42 can continue in the second orientation.

Subsequent operations can include completing the fabrication of the truss spar hull platform 30. For example, guides for the risers and umbilical in the center well opening 58, and other structural members can be coupled, as may be required. Electrical, plumbing, and mechanical components can be added to the structure. The combined trust bar hull platform can then be towed to the installation site, up-ended, and a topsides and other components attached thereto.

The system and method provides an innovative approach to solving a significant issue in coupling such large structures. The integral skirt tank can be flooded after the truss spar hull platform is up-ended and does not need to further retain its buoyancy, in at least one embodiment.

Other and further embodiments utilizing one or more aspects of the invention described above can be devised without departing from the spirit of the invention. For example and without limitation, the skirt tank, and components thereof, can be round or other geometric shapes, so that the use of the term "diameter" is to be construed broadly to mean a cross-sectional dimension across an inside or outside periphery, as the case may or may not be round. The legs can vary in number and position. The shape, size, and location of the mating portions between the hull and skirt tank can vary. Further, the embodiments have generally been described in terms of welding for coupling the sections together, because the general state of the art is conducive to welding, but the invention is not limited to welding and can include any suitable form of coupling, such as clamping, grouting, fastening, and other coupling means as further defined herein. Other variations in the system are possible.

Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventive subject matter has been described in the context of preferred and other embodiments and not every embodiment has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A multi-sectional offshore floating platform, comprising:

a truss comprising:

a plurality of legs having an upper portion and a lower portion; and a skirt tank coupled to the upper portion of the legs, the skirt tank comprising:

a peripheral outer shell;

an upper deck disposed at least partially across a cross-sectional portion of the outer shell and coupled to the outer shell, the upper deck having a skirt mating portion; and a lower deck disposed at least partially across a cross-sectional portion of the outer shell and coupled to the outer shell distally from the upper deck and toward the lower portion of the legs;

at least one of the decks having an opening therethrough and the skirt tank being buoyant above a water level that is lower than the opening when the skirt tank is horizontal in water at a first orientation, and the opening configured that when the skirt tank is rotated in water to a second orientation the water level is above at least a portion of the opening; and a hull comprising one or more buoyancy tanks and a hull mating portion disposed adjacent the skirt mating portion, the mating portions configured to be at least partially sealingly coupled together.

2. The system of claim 1, wherein the lower deck opening comprises an opening for mounting risers from the hull therethrough.

3. The system of claim 1, wherein the upper deck opening comprises an opening across a portion of the cross-section of the skirt tank, the opening in the upper deck being disposed above the water level in a first orientation of the skirt tank when uncoupled to the hull, and further being disposed at least partially below the water level in a second orientation when the skirt tank is at least partially coupled to the hull.

4. The system of claim 1, wherein the buoyancy tanks comprise at least one variable ballast tank.

5. The system of claim 1, wherein the truss comprises a float tank coupled to the lower portion of the legs.

6. The system of claim 1, wherein the skirt tank is configured to be flooded when the offshore floating platform is up-ended.

7. A method of manufacturing a multi-sectional offshore floating platform, the floating platform having at least two sections, one section being a truss with a skirt tank, the skirt tank having a peripheral outer shell with an upper deck and a lower deck disposed at least partially across a cross-sectional portion of the outer shell and coupled to the outer shell with an opening through at least one of the decks, the upper deck having a skirt mating portion, and a second section being a hull with a hull mating portion, the method comprising:

floating the upper portion of the truss with the skirt tank at a water level that is below the opening in the decks;

aligning the skirt mating portion and the hull mating portion;

sealingly coupling a first portion of an interface between the skirt mating portion and the hull mating portion together above the water level in a first orientation;

rotating the truss with the skirt mating portion and the hull with the hull mating portion to a second orientation around a longitudinal axis; and coupling a second portion of the interface between the skirt mating portion and the hull mating portion together above the water level in the second orientation that was previously below the water level in the first orientation.

8. The method of claim 7, further comprising up-ending the offshore floating platform and flooding the skirt tank.

9. The method of claim 7, wherein the truss, hull, or a combination thereof comprises one or more variable ballast tanks, and further comprising adjusting an amount of buoyancy in one or more of the variable ballast tanks to align the mating portions of the truss and hull for coupling.

* * * * *